US012453454B2

(12) United States Patent
Bhat et al.

(10) Patent No.: US 12,453,454 B2
(45) Date of Patent: Oct. 28, 2025

(54) DISHWASHER WITH A HOUSING

(71) Applicant: WHIRLPOOL CORPORATION, Benton Harbor, MI (US)

(72) Inventors: Ajinkya Anish Bhat, Pune (IN); Waldemar Piotr Muzyka, Wroclaw (PL); Malhar Devidas Tidke, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 326 days.

(21) Appl. No.: 17/888,681

(22) Filed: Aug. 16, 2022

(65) Prior Publication Data

US 2024/0057844 A1 Feb. 22, 2024

(51) Int. Cl.
*A47L 15/42* (2006.01)
*A47L 15/46* (2006.01)

(52) U.S. Cl.
CPC ..... *A47L 15/421* (2013.01); *A47L 15/4274* (2013.01); *A47L 15/46* (2013.01); *A47L 2401/34* (2013.01)

(58) Field of Classification Search
CPC ..... A47L 15/421; A47L 15/4212; A47L 15/4251; A47L 15/4274
See application file for complete search history.

(56) References Cited

U.S. PATENT DOCUMENTS 4,767,355 A * 8/1988 Phillipson ..... H01R 13/6599 439/425
5,039,828 A * 8/1991 Marks ..... A47L 15/4257 49/167
8,613,289 B2 12/2013 Tameishi et al.
10,022,035 B2 7/2018 Dabade et al.
2009/0126465 A1* 5/2009 Kedjierski ..... G01M 3/186 73/40.5 R
2014/0154921 A1* 6/2014 Qi ..... H01R 13/6581 439/620.03
2016/0095495 A1 4/2016 Lindgren et al.
2020/0060510 A1 2/2020 Kretz et al.

FOREIGN PATENT DOCUMENTS

| | | | |
|---|---|---|---|
| CN | 201562770 | U | 8/2010 |
| DE | 102004056501 | A1 | 5/2006 |
| DE | 102008020888 | A1 | 10/2009 |
| EP | 0382999 | A2 | 8/1990 |
| EP | 0695825 | B1 | 12/1998 |
| EP | 0887041 | A2 | 12/1998 |
| GB | 2387043 | A | 10/2003 |
| WO | 2005064067 | A1 | 7/2005 |
| WO | 2020/097791 | A1 | 5/2020 |
| WO | 2020229032 | A1 | 11/2020 |

OTHER PUBLICATIONS

European Search Report for Counterpart EP23191293.2, Dated Dec. 11, 2023, 8 Pages.

* cited by examiner

*Primary Examiner* — David G Cormier
(74) *Attorney, Agent, or Firm* — McGarry Bair PC

(57) ABSTRACT

A dishwasher and method of operating a dishwasher according to a cycle of operation includes a set of electrical components, a controller operably coupled to the set of electrical components, and an electrical connector electrically coupling the controller to at least one electrical component in the set of electrical components.

20 Claims, 8 Drawing Sheets

DISHWASHER WITH A HOUSING

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system can be provided for recirculating liquid throughout the tub to remove soils from the dishes. The spray system can include rotating or stationary sprayers. A user interface can be provided for selecting, modifying, or otherwise controlling a cycle of operation.

BRIEF DESCRIPTION

In one aspect, the disclosure relates to a dishwasher. The dishwasher includes a chassis defining an interior, a tub located within the interior and defining a treating chamber, a set of electrical components, a controller operably coupled to the set of electrical components, an electrical connector electrically coupling the controller to at least one electrical component in the set of electrical components, and a housing at least partially forming a water barrier chamber receiving the electrical connector, and also forming a radio frequency interference (RFI) barrier.

In another aspect, the disclosure relates to a dishwasher. The dishwasher includes a chassis defining an interior, a tub located within the interior and defining a treating chamber, a first electronic component and a second electronic component located within the chassis, an electrical connector electronically coupling the first electronic component to the second electronic component, and a housing projecting from the chassis into the interior, the housing at least partially forming a water barrier chamber receiving the electrical connector, and also forming a radio frequency interference (RFI) barrier.

DETAILED DESCRIPTION

Figure 1:
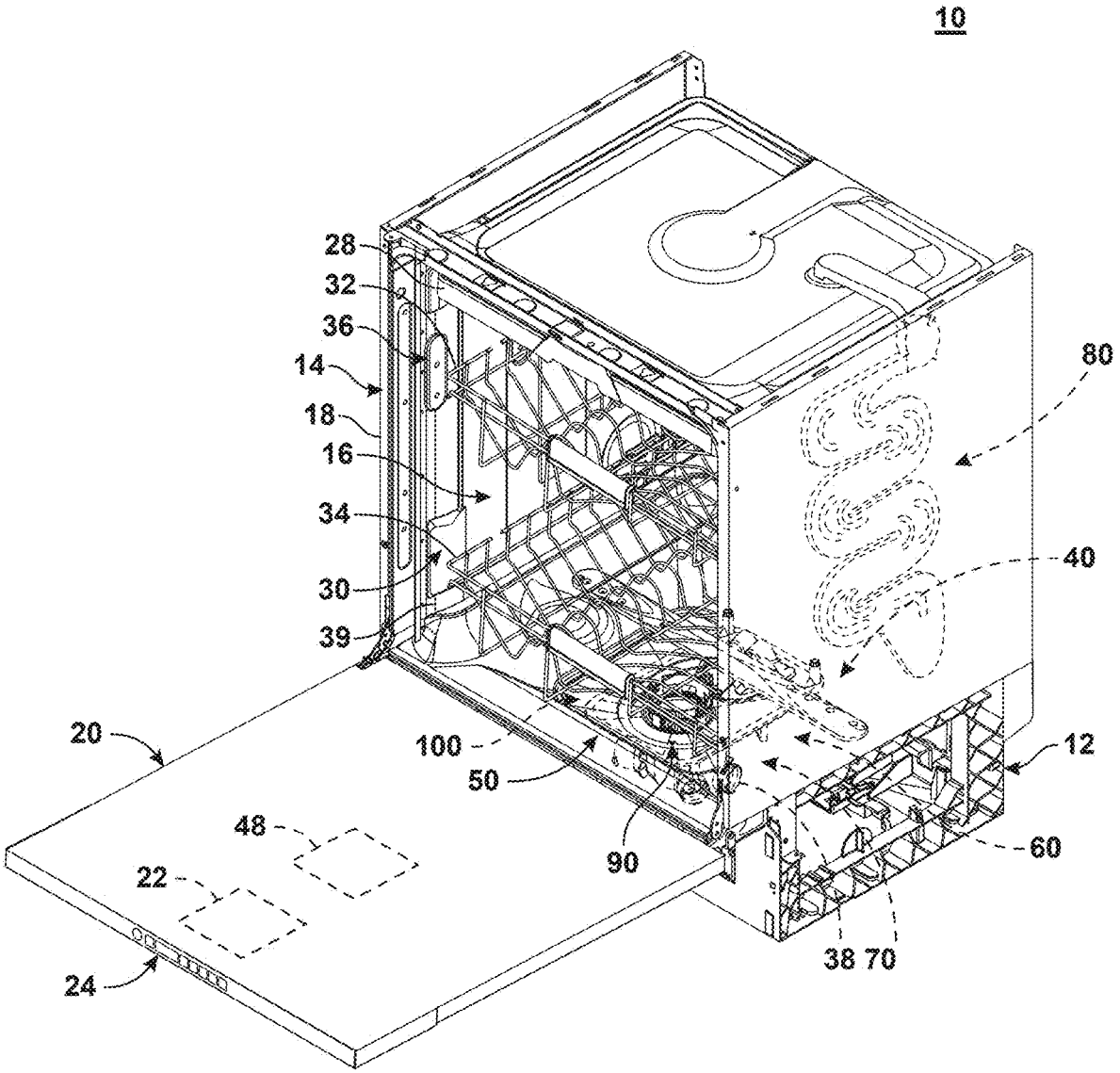
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" or "dish item(s)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis 11 is provided to support the variety of systems needed to implement the automatic cycle of operation. As illustrated, for a built-in implementation, the chassis 11 includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis 11, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis 11 can be a tub that is slidable relative to a frame, with the closure being a part of the chassis 11 or the countertop of the surrounding cabinetry. In a sink-type implementation, the sink forms the tub and the cover closing the open top of the sink forms the closure. Sink-type implementations are more commonly found in recreational vehicles.

The systems supported by the chassis 11, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls a set of electrical components 150 (shown in FIG. 3) for the various components of the dishwasher 10 to implement the cycle of operation. The controller 22 can be located within the door assembly 20 as illustrated, or it can alternatively be located somewhere within the chassis 11. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis 11. The dispenser assembly 48 can dispense one or more types of treating chemistries. The dispenser assembly 48 can be a single-use dispenser or a bulk dispenser, or a combination of both.

Figure 2:
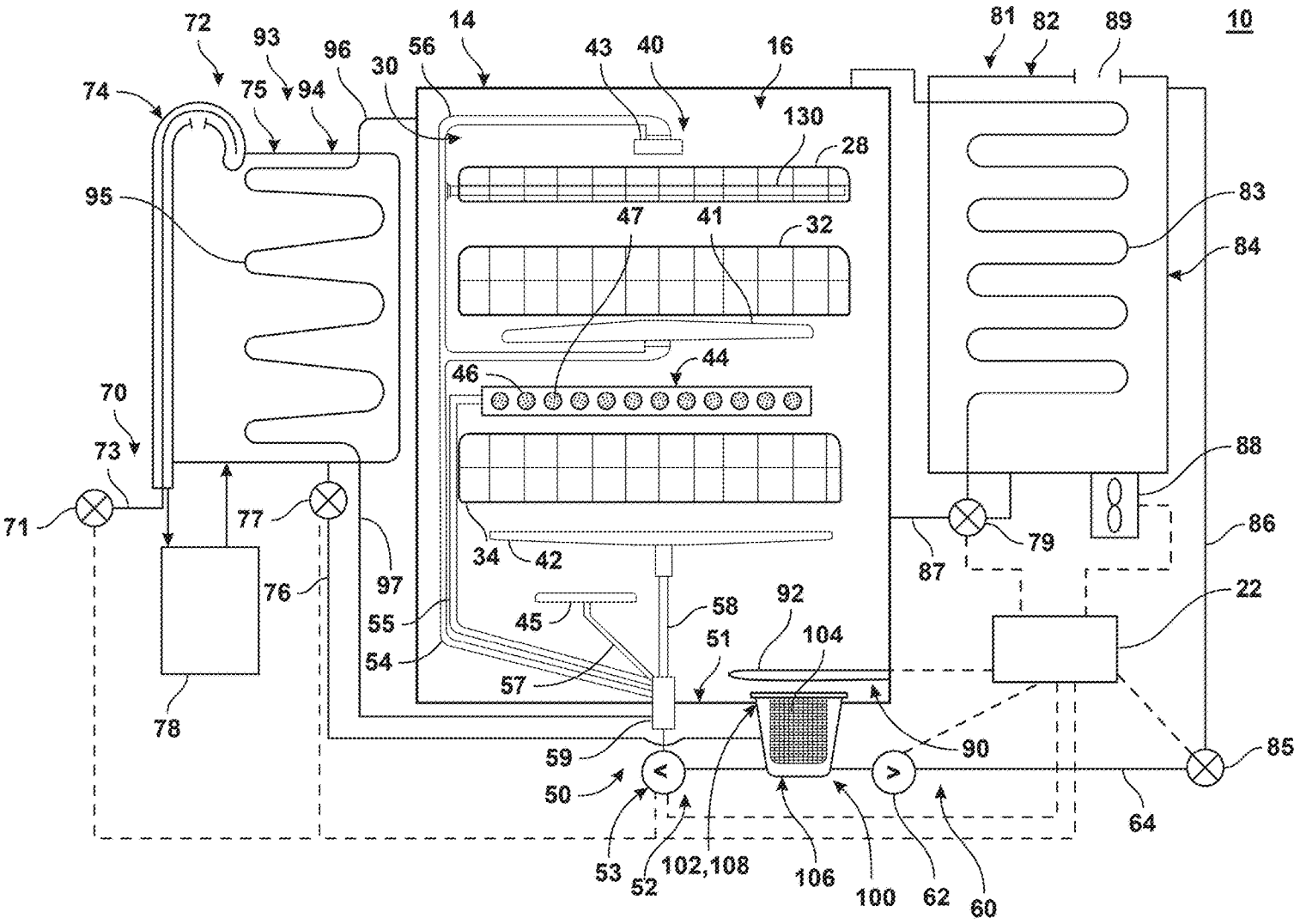
FIG. 2 is a schematic front view of the dishwasher of FIG. 1 illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple liquid supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
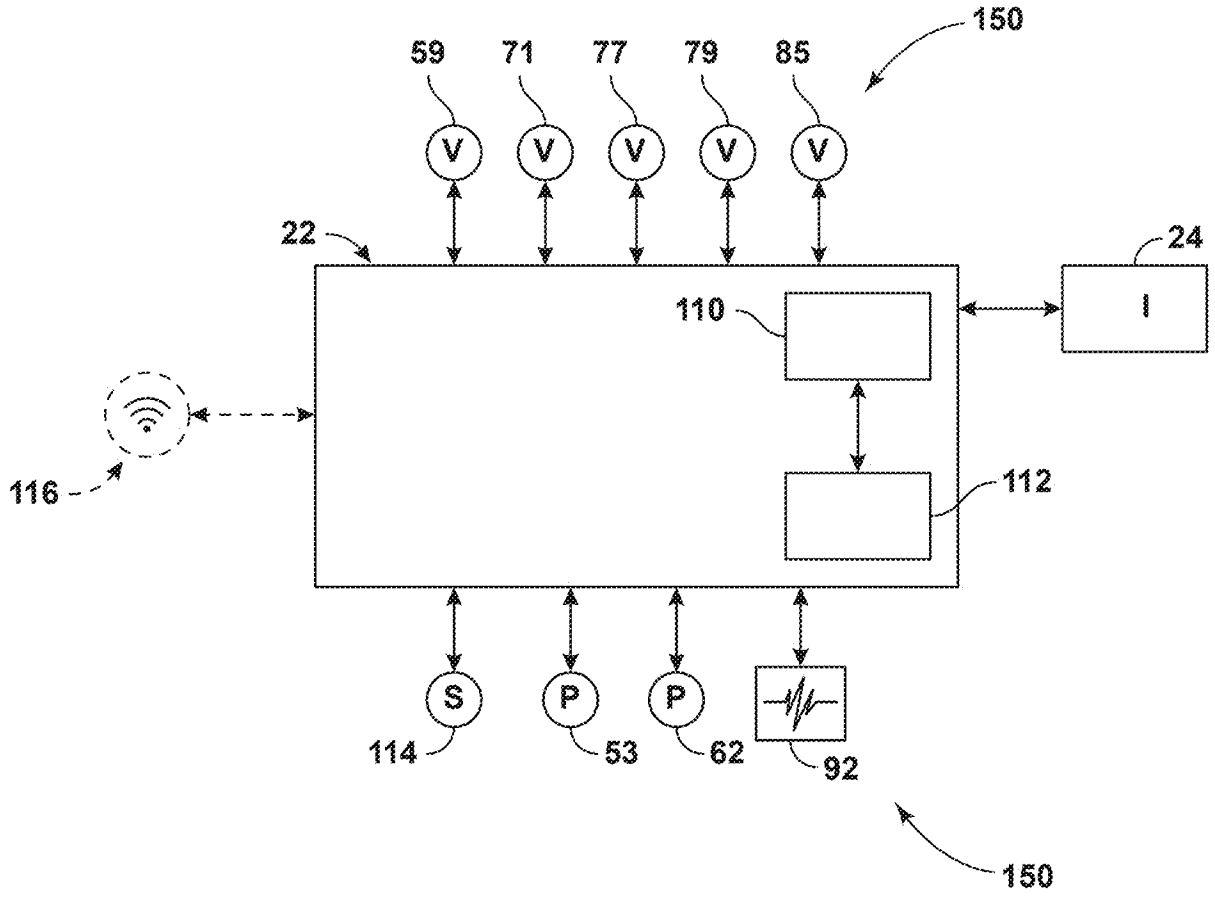
FIG. 3 is a schematic view of a controller of the dishwasher of FIG. 1.

As illustrated schematically in FIG. 3, the controller 22 can be coupled with the set of electrical components 150 for various operations during a cycle of operation. The set of electrical components 150 can include the heater 92 for heating the wash liquid during a cycle of operation, the drain pump 62 for draining liquid from the treating chamber 16 (FIG. 2), and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
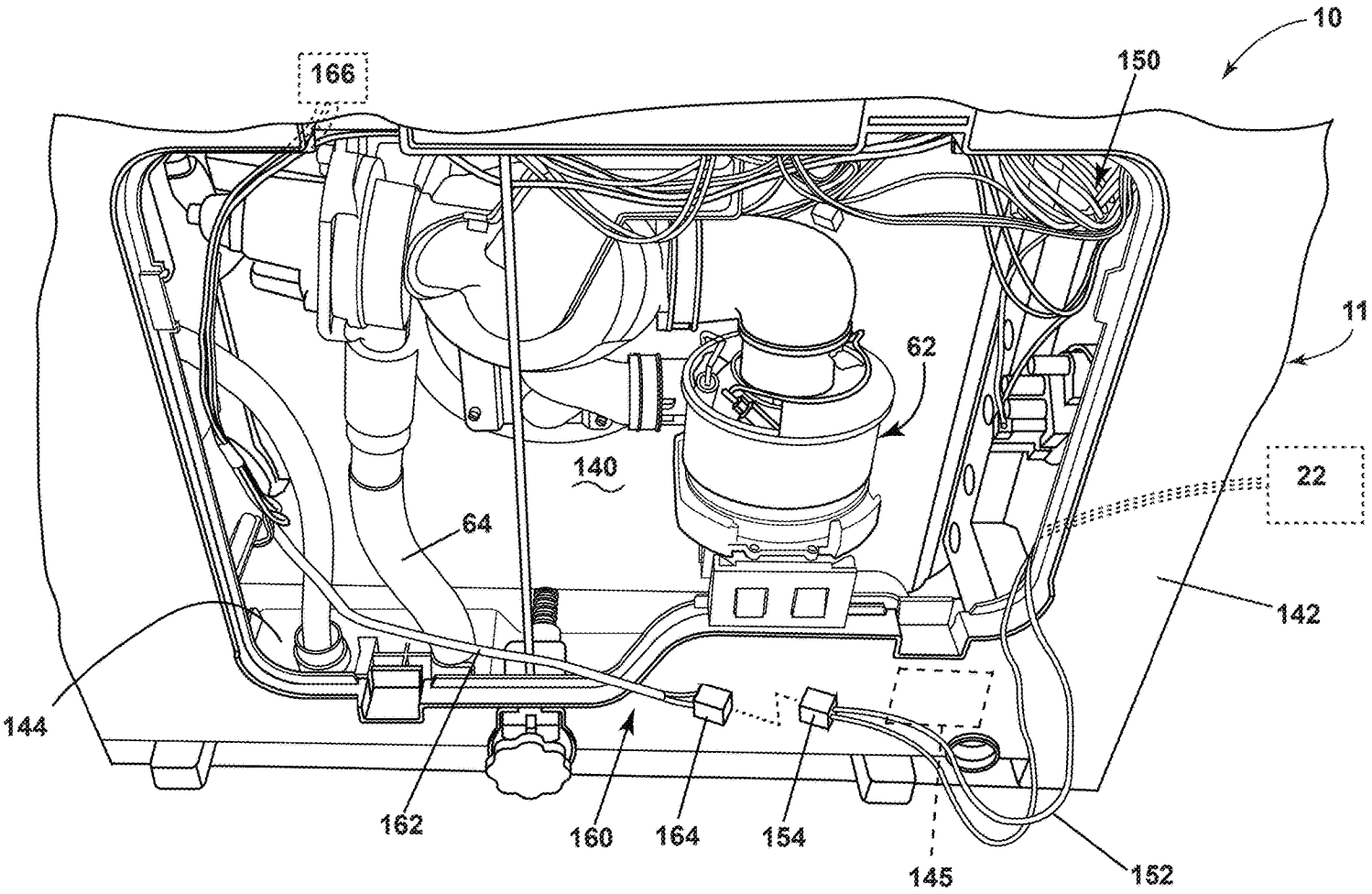
FIG. 4 is a rear perspective view of the dishwasher of FIG. 1 illustrating a chassis and a set of electrical components in accordance with various aspects described herein.

FIG. 4 illustrates a rear perspective view of the chassis 11. The chassis 11 defines an interior 140 and includes at least a rear wall 142 and a bottom wall 144 as shown. In some examples, the bottom wall 144 can form part of the base 12 (FIG. 1). Additionally or alternatively, the bottom wall 144 can be separate or spaced from the base 12 (FIG. 1). The drain pump 62, a portion of the drain line 64, and other electrical components in the set of electrical components 150 are also shown within the interior 140.

At least one electrical connector can also be provided in the dishwasher 10. In the illustrated example, the at least one electrical connector includes a harness connector 154 and a sensor connector 164. A wiring harness 152 can electrically couple the controller 22 to the harness connector 154. The wiring harness 152 and harness connector 154 are illustrated partially outside of the chassis 11 for visual clarity. The drain sensor assembly 160 can include wiring 162 coupling a sensor 166 to the sensor connector 164. The sensor connector 164 can be coupled to the harness connector 154 for operably coupling the controller 22 to the drain sensor assembly 160. It will be understood that any electrical component can be operably coupled to the controller 22 by way of the harness connector 154, with the drain sensor assembly 160 representing one such example. Furthermore, in another example a single electrical connector can be provided for direct coupling the wiring 162 of the drain sensor assembly 160 to the wiring harness 152 of the controller 22. A portion 145 of the chassis 11 is indicated where the harness connector 154 and sensor connector 164 can be positioned within the interior 140.

A housing 170 can also be provided for securing either or both of the harness connector 154 or the sensor connector 164 within the interior 140. The housing 170 can be located or positioned on an internal surface 143 of the rear wall 142.

In addition, the housing 170 can be spaced from a pump of the dishwasher, such as the drain pump 62. More specifically, the housing 170 and drain pump 62 can be offset from one another in a direction along the rear wall 142. In this manner, the housing 170 can be more easily accessed from the rear wall 142.

Figure 5:
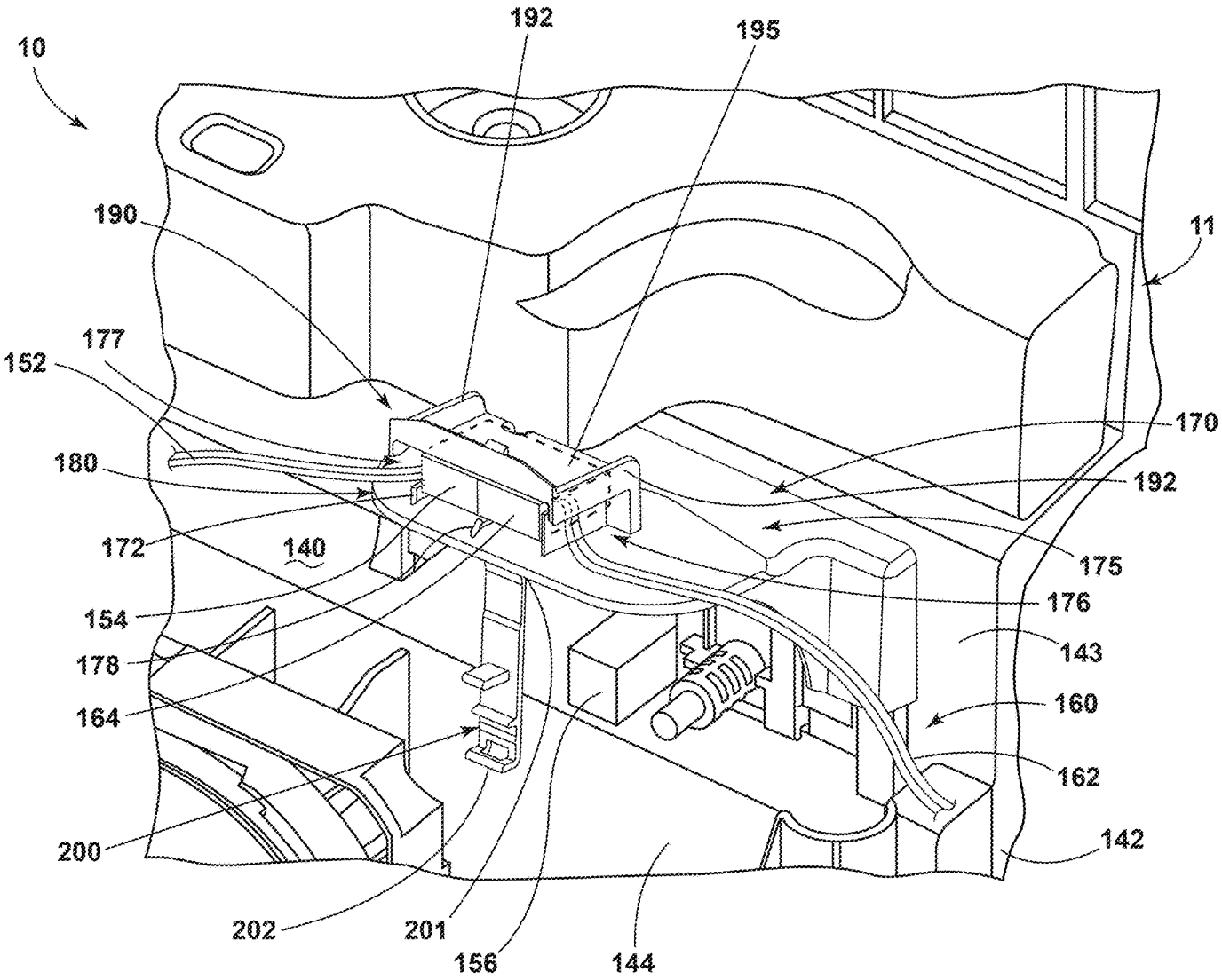
FIG. 5 is a perspective view of an interior of the chassis of FIG. 4 illustrating a housing in accordance with various aspects described herein.

Turning to FIG. 5, an internal view of the chassis 11 illustrates the internal surface 143 of the rear wall 142 in the portion 145. The harness connector 154 and the sensor connector 164 are coupled together and received within the housing 170. In the example shown, the housing 170 projects from the rear wall 142 into the interior 140 of the chassis 11 in a cantilevered manner. In some examples, the housing 170 can be unitarily formed with the rear wall 142 of the chassis 11. In some examples, the housing 170 can include a mechanical connector for securing to the rear wall 142.

The housing 170 can at least partially form a water barrier chamber 190 and a radio frequency interference (RFI) barrier 180. In the example shown, the housing 170 can include a platform 175 at least partially forming the RFI barrier 180 and the water barrier chamber 190, though this need not be the case. It is contemplated that the RFI barrier 180 and water barrier chamber 190 can be separately defined in the housing 170 without sharing a common wall. In addition, the RFI barrier 180 can overlie at least one additional electrical component, such as a second electrical connector 156, for other components of the dishwasher 10.

The water barrier chamber 190 can receive the at least one electrical connector, such as the sensor connector 164 or the harness connector 154. In the example shown, the sensor connector 164 is coupled to the harness connector 154, and the coupled connectors 154, 164 are positioned within the water barrier chamber 190.

The water barrier chamber 190 can include a top cap 195 overlying at least one of the sensor connector 164 or the harness connector 154. The top cap 195 can have an L-shaped geometric profile. The top cap 195 can be connected to the platform 175 as shown. In this manner, the water barrier chamber 190 can be positioned above the RFI barrier 180 with respect to the bottom wall 144 of the chassis 11.

At least one wire guide can be provided in the housing 170. In the example shown, an upper portion of the top cap 195 can include first and second flanges 191, 192. A first sidewall 171 can extend from the platform 175 toward the top cap 195 to at least partially form a first wire guide 176 adjacent the first flange 191. A second sidewall 172 can extend from the platform 175 toward the top cap 195 to at least partially form a second wire guide 177 adjacent the second flange 192. In this manner, the wiring 162 of the drain sensor assembly 160 and the wiring harness 152 of the controller 22 (FIG. 4) can be directed out of the water barrier chamber 190 to their respective portions of the dishwasher 10.

In addition, a spacer 178 can also be provided along the platform 175 between the first and second sidewalls 171, 172. The spacer 178 can be positioned between the platform 175 and either or both of the harness connector 154 or sensor connector 164 to form a gap therebetween. The spacer 178 can increase air exposure and reduce contact between the harness and sensor connectors 154, 164 and interior surfaces of the water barrier chamber 190, thereby protecting the connectors 154, 164 from moisture within the chassis 11.

A clip 200 can also be provided for securing an electrical connector, such as the sensor connector 164 or the harness connector 154, within the water barrier chamber 190. The clip 200 can include a flexible body in some examples. A first end 201 can extend from the housing 170, and a second end 202 can be rotatable around the sensor connector 164 or harness connector 154 for securing to a portion of the housing, such as the top cap 195.

Figure 6:
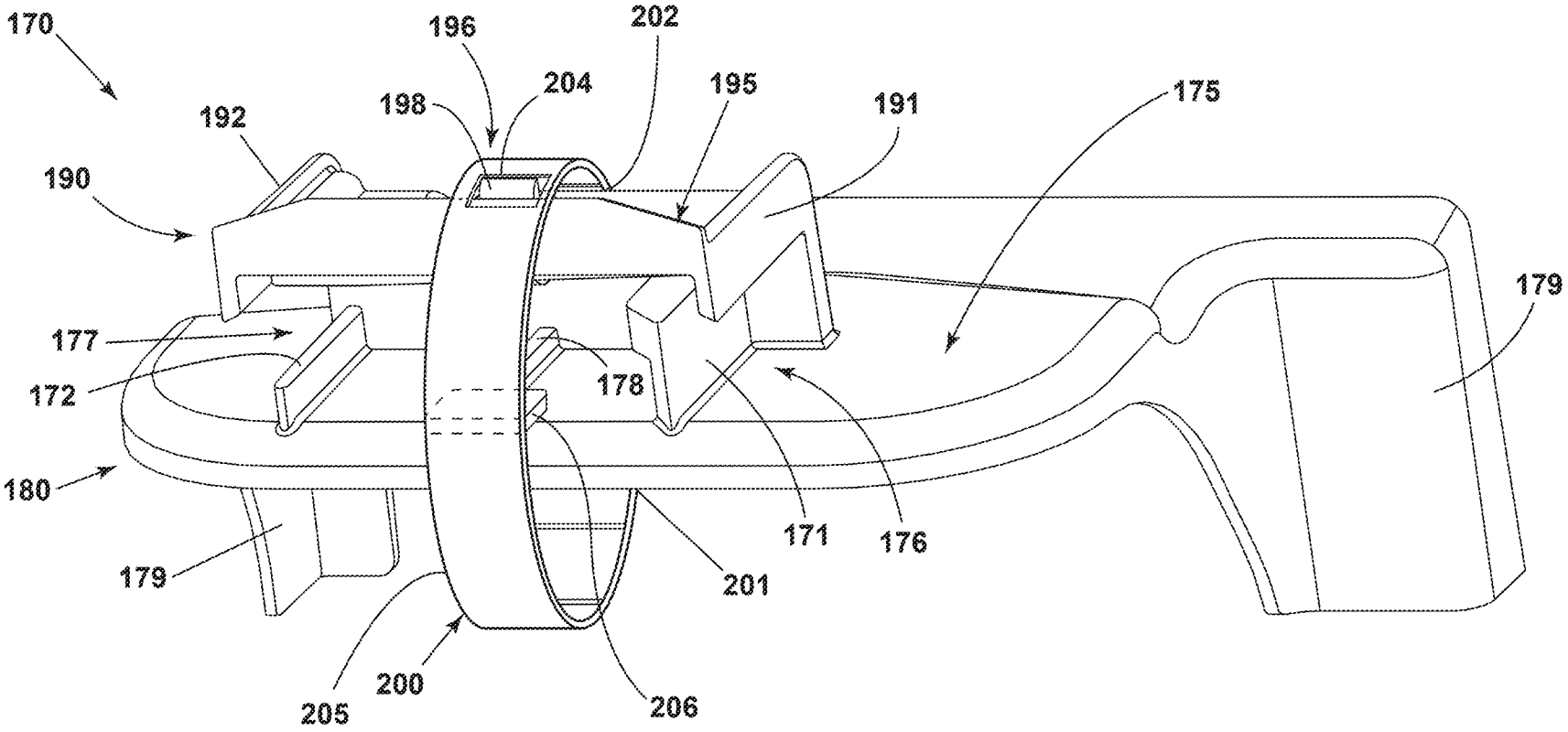
FIG. 6 is a front perspective view of the housing of FIG. 5 in accordance with various aspects described herein.

Referring now to FIG. 6, additional details of the housing 170 are shown. The platform 175 can extend between side legs 179 configured to couple to the rear wall 142 of the chassis 11 (FIG. 5). The first sidewall 171 and the first flange 191 can form the first wire guide 176 with a serpentine geometric profile as shown. The second sidewall 172 and the second flange 192 can form the second wire guide 177. In the illustrated example, the first sidewall 171 has a taller height than the second sidewall 172 though this need not be the case. In some examples, the first and second sidewalls 171, 172 can have the same height, or the second sidewall 172 can be taller than the first sidewall 171.

In some examples, the housing 170 can be unitarily formed with the clip 200 to define an integral hinge 205. Furthermore, a snap-fit coupling 196 can be provided between the clip 200 and the water barrier chamber 190. More specifically, the second end 202 of the clip 200 can include an aperture 204 and the top cap 195 of the water barrier chamber 190 can include a projection 198. When the clip 200 is in a closed position, the projection 198 can extend through the aperture 204 to form the snap-fit coupling 196 and secure the clip 200 in place. In addition, the clip 200 can include a second spacer 206 forming a gap between the clip 200 and either or both of the harness connector 154 or sensor connector 164 (FIG. 5), thereby improving airflow around the connectors 154, 164 (FIG. 5).

Figure 7:
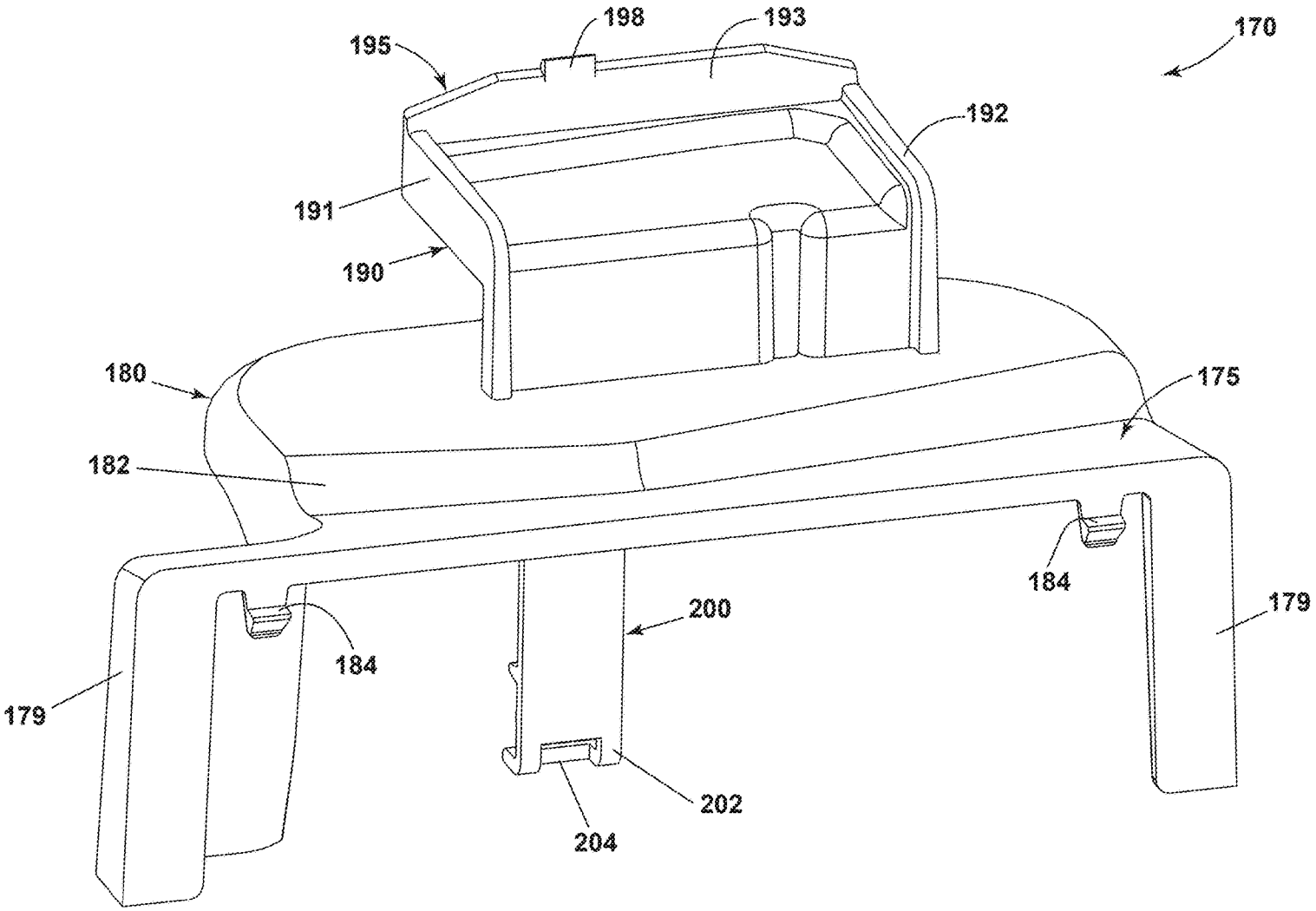
FIG. 7 is a rear perspective view of the housing of FIG. 5 in accordance with various aspects described herein.

FIG. 7 illustrates a rear perspective view of the housing 170. It is contemplated that the platform 175 can include a vertical step 182 between the side legs 179 and the top cap 195 as shown. A rear portion of the platform 175 can also include mounting connectors 184 for coupling to the rear wall 142 of the chassis 11 (FIG. 5), though this need not be the case.

In addition, the projection 198 can be provided on a front flange 193 of the top cap 195. Additionally or alternatively, one or more snap-fit couplings can be provided on portions of the top cap 195, including an upper surface, for added security when the clip 200 is in a closed position.

Figure 8:
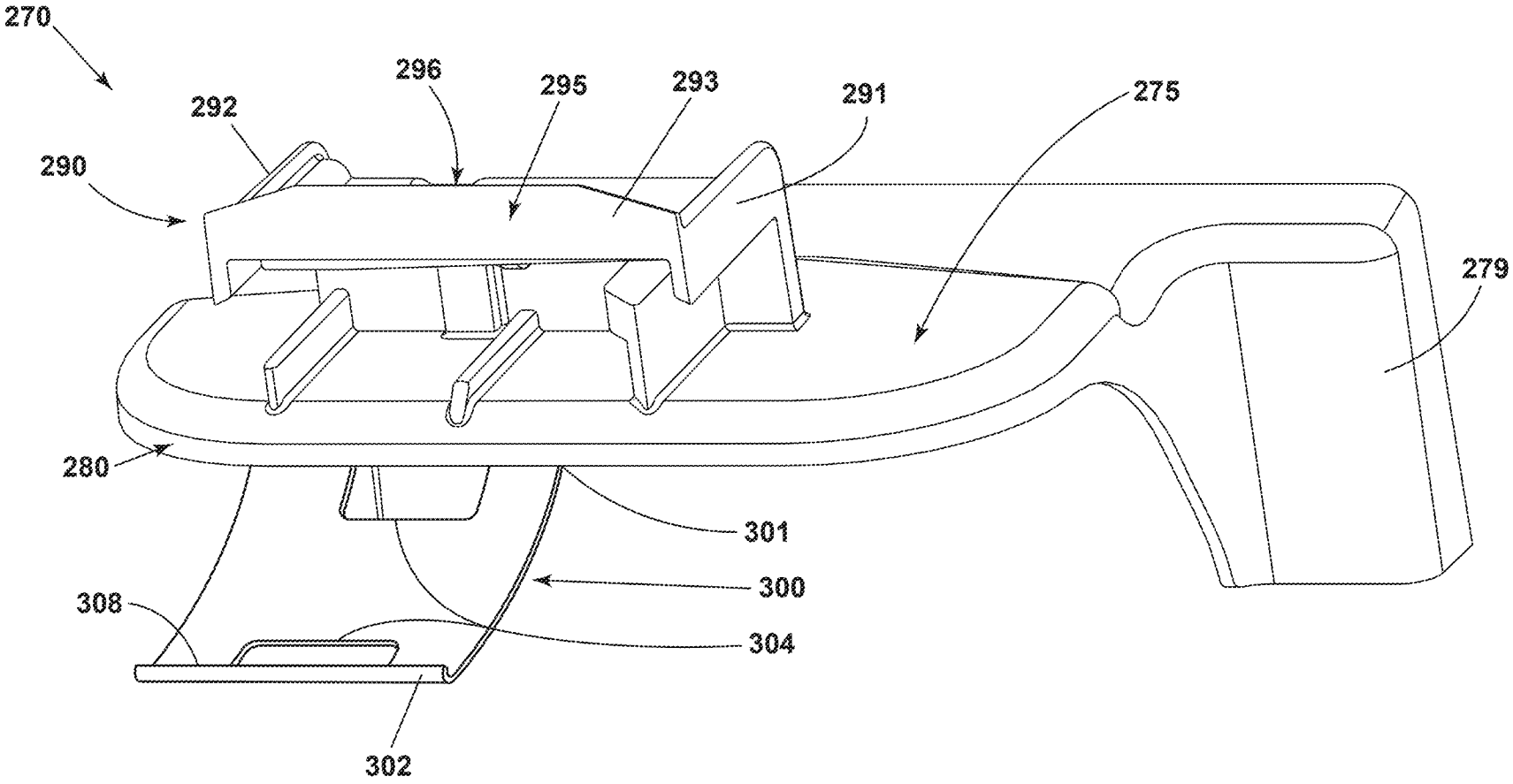
FIG. 8 illustrates another housing that can be utilized in the dishwasher of FIG. 1 in accordance with various aspects described herein.

Referring now to FIG. 8, another housing 270 is shown that can be utilized in the dishwasher 10 (FIG. 1). The housing 270 is similar to the housing 170; therefore, like parts will be identified with like numerals increased by 100, with it being understood that the description of the like parts of the housing 170 applies to the housing 270, except where noted.

The housing 270 can include an RFI barrier 280 and a water barrier chamber 290. The housing 270 can also include a platform 275, a top cap 295, and side legs 279. The top cap 295 can include a first flange 291, a second flange 292, and a front flange 293 as shown.

A clip 300 can be provided with the housing 270. The clip 300 can include a first end 301 and a second end 302. One difference compared to the clip 200 is that the clip 300 can be in the form of a rigid tab extending from a rotatable first end 301 to a second end 302. Another different compared to the clip 200 is that multiple apertures 304 can be provided in the clip 300.

A snap-fit coupling 296 can be provided between the clip 300 and the top cap 295. Another difference compared to the clip 200 is that the clip 300 can include a projecting ridge 308 along the second end 302 for engagement with the top cap 295. More specifically, the ridge 308 can snap directly onto the front flange 293 to secure the clip 300 in a closed position.

Aspects of the disclosure provide for several benefits. The common housing for the water barrier chamber and RFI barrier provides for a reduction in part complexity, assembly times, and production costs. Compared to traditional electrical connector chambers that are located behind or beneath other dishwasher components (e.g. the drain pump), the positioning of the housing along the rear wall and offset from other dishwasher components provides for easier access of the electrical connector(s) for installation or servicing. In addition, portions of the RFI barrier can be used to direct wiring away from the water barrier chamber and associated wire guides, by way of the shared wall/platform, providing for added protection of electronic components.

Other benefits include that the clip can provide improved security for electrical connectors positioned within the water barrier chamber. The flexible-body clip described herein can accommodate a variety of connector geometries that may protrude slightly out of the water barrier chamber. The tab-body clip described herein can be directly connected to the top cap without need of additional snap-fit projections, providing additional streamlining and reduction of part complexity.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher, comprising:

a chassis defining an interior;

a tub located within the interior and defining a treating chamber;

a set of electrical components;

a controller operably coupled to the set of electrical components;

an electrical connector electrically coupling the controller to at least one electrical component in the set of electrical components;

a housing at least partially forming a water barrier chamber receiving the electrical connector, and also forming a radio frequency interference (RFI) barrier, the housing having a top cap and a platform, the platform at least partially forming the RFI barrier and having a first side and a second side, the water barrier chamber being formed between opposing portions of the first side of the platform and the top cap; and a clip securing the electrical connector within the water barrier chamber, the clip extending from the second side, to the first side, along a respective portion of the top cap, and at least partially overlying the water barrier chamber when in a closed position.

2. The dishwasher of claim 1, wherein the housing is unitarily formed with the clip to define an integral hinge.

3. The dishwasher of claim 1, wherein the clip comprises one of a flexible body or a rigid tab with a first end coupled to the housing and a second end rotatable around the electrical connector.

4. The dishwasher of claim 1, further comprising a snap-fit coupling between the clip and the water barrier chamber.

5. The dishwasher of claim 1, wherein the water barrier chamber is positioned above the RFI barrier with respect to a bottom of the chassis.

6. The dishwasher of claim 1, wherein the housing is located within the interior on a rear wall of the chassis.

7. The dishwasher of claim 6, wherein the housing comprises a mechanical connector for securing to the rear wall.

8. The dishwasher of claim 6, further comprising a pump located within the chassis, wherein the housing is spaced from the pump along the rear wall.

9. The dishwasher of claim 1, wherein the top cap has an L-shaped geometric profile.

10. The dishwasher of claim 9, further comprising a sidewall extending from the first side of the platform and toward the top cap to form a wire guide.

11. The dishwasher of claim 1, further comprising a spacer positioned between the electrical connector and the platform to form a gap therebetween.

12. The dishwasher of claim 1, wherein the at least one electrical component comprises a leak detection sensor.

13. The dishwasher of claim 1, wherein at least one additional electrical component in the set of electrical components is positioned within the chassis beneath the RFI barrier on a second side of the platform, opposite the first side.

14. A dishwasher, comprising:

a chassis defining an interior;

a tub located within the interior and defining a treating chamber;

a first electronic component and a second electronic component located within the chassis;

an electrical connector electronically coupling the first electronic component to the second electronic component; and a housing projecting from the chassis into the interior, the housing at least partially forming a water barrier chamber receiving the electrical connector, and also forming a radio frequency interference (RFI) barrier, the housing comprising:

a platform having a first surface;

a top cap connected to the platform, the water barrier chamber being formed by a space between opposing portions of the first surface of the platform and the top cap, the top cap having a first flange, and an opening; and a first sidewall extending from the first surface of the platform and being adjacent to the first flange, the first sidewall being at least partially overlaid by the top cap, the first sidewall and the first flange collectively forming a first wire guide through which a first wire extends through the opening, around a respective portion of the first flange and the sidewall, and to the electrical connector.

15. The dishwasher of claim 14, wherein the top cap has an L-shaped geometric profile.

16. The dishwasher of claim 14, wherein the top cap comprises a second flange spaced from the first flange.

17. The dishwasher of claim 16, wherein the housing comprises a second sidewall adjacent to the second flange and spaced from the first flange, the second sidewall being at least partially overlaid by the top cap.

18. The dishwasher of claim 17, wherein the second flange and the second sidewall collectively form a second wire guide through which a second wire extends from the electrical connector, around a respective portion of the second sidewall and the second flange, and through a respective portion of the opening.

19. The dishwasher of claim 17, wherein the housing comprises a spacer located between the first sidewall and the second sidewall, the spacer configured to create a gap between the electrical connector and the platform.

20. The dishwasher of claim 17, wherein the electrical connector is receivable between the first sidewall and the second sidewall.

* * * * *